US006886201B1

(12) United States Patent
Weiss-Lohrei

(10) Patent No.: US 6,886,201 B1
(45) Date of Patent: May 3, 2005

(54) MATERNITY PILLOW

(76) Inventor: Therese A. Weiss-Lohrei, 520 Augusta Dr. West, Sinking Spring, PA (US) 19608

( * ) Notice: Subject to any disclaimer, the term of this patent is extended or adjusted under 35 U.S.C. 154(b) by 65 days.

(21) Appl. No.: 10/698,244

(22) Filed: Oct. 31, 2003

(51) Int. Cl.[7] ..... A47G 9/10
(52) U.S. Cl. ..... 5/631; 5/490; 5/930
(58) Field of Search ..... 5/630–632, 930, 5/490

(56) References Cited

U.S. PATENT DOCUMENTS

| | | | | | |
|---|---|---|---|---|---|
| 2,314,080 | A | | 3/1943 | Dine | 5/327 |
| 2,562,725 | A | | 7/1951 | Leto | 5/338 |
| 2,952,856 | A | | 9/1960 | Ruff | 5/338 |
| 4,288,879 | A | * | 9/1981 | Pate | 5/631 |
| 4,397,052 | A | | 8/1983 | Lund | 5/431 |
| 4,506,396 | A | | 3/1985 | Ritchie | 5/431 |
| 4,748,702 | A | * | 6/1988 | Sandler | 5/636 |
| 5,182,828 | A | | 2/1993 | Alivizatos | 5/631 |
| D333,938 | S | * | 3/1993 | Watson et al. | D6/601 |
| 5,272,780 | A | | 12/1993 | Clute | 5/655 |
| 5,664,271 | A | | 9/1997 | Bellavance | 5/632 |
| 5,978,990 | A | | 11/1999 | Akey | 5/632 |
| 6,047,419 | A | | 4/2000 | Ferguson | 5/630 |
| 6,052,848 | A | * | 4/2000 | Kelly | 5/632 |
| 6,560,800 | B1 | | 5/2003 | Draves | 5/630 |

* cited by examiner

*Primary Examiner*—Robert E. Pezzuto
*Assistant Examiner*—Tara L. Mayo

(57) ABSTRACT

A pair of opposing pillows is interconnected by a connecting member to provide an adjustable transverse spacing between the opposing pillows. Each asymmetrical opposing pillow is formed with a sloped portion to provide proper support for the abdomen of a pregnant woman sleeping on her side and an adjacent thick portion to provide proper support for the legs of the pregnant woman. The sloped portion is formed with internal baffles to maintain the sloped configuration. The connecting member is attached to the pillow case for one of the pillows and has loop fastener strips affixed in a transversely spaced manner to permit a detachable connection to a hook strip affixed to the underside of the opposing pillow. The pillow case for the opposing pillow is formed with a reinforced opening therein to permit engagement between the hook and loop fastener strips on the pillow and connecting member, respectively.

20 Claims, 6 Drawing Sheets

Fig. 7
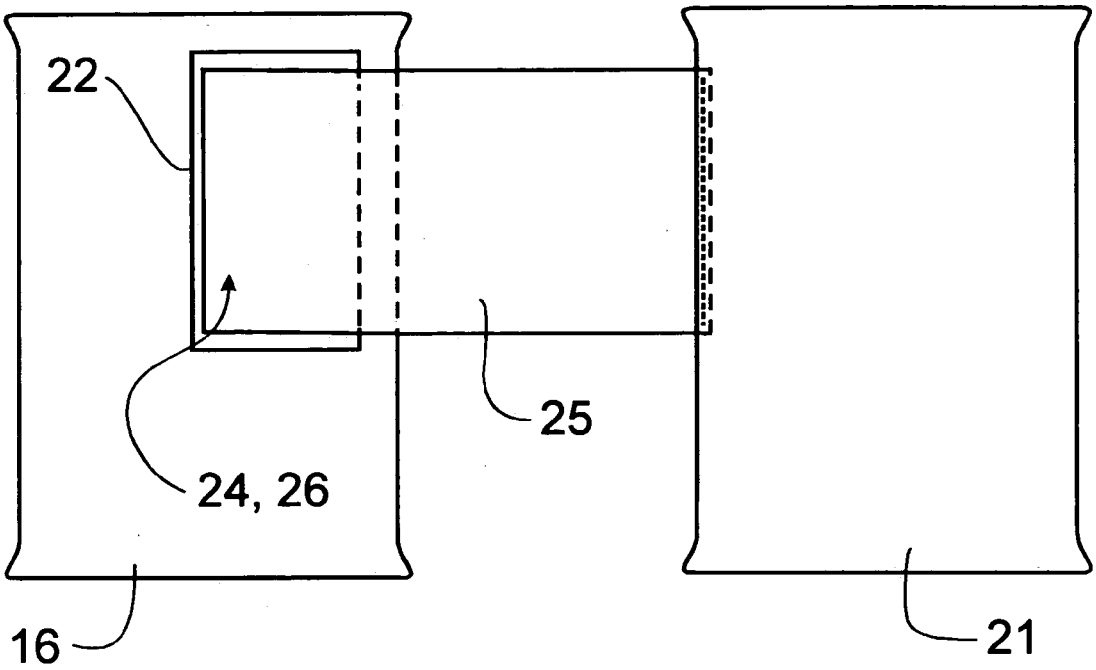
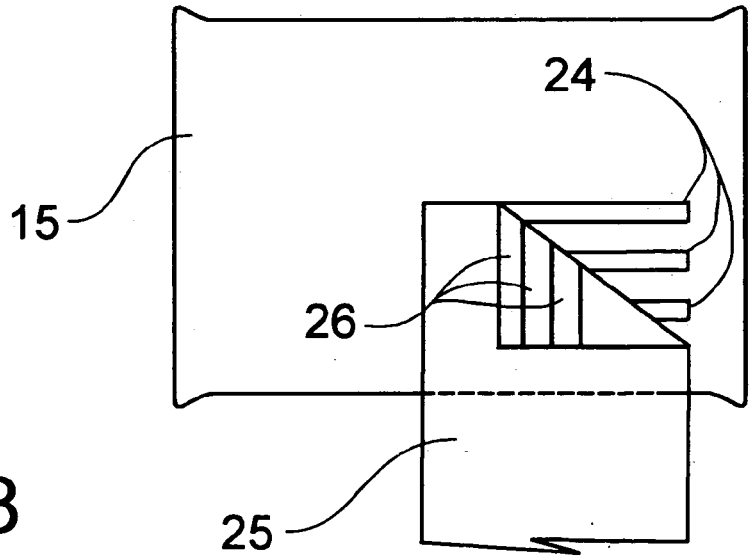
Fig. 8

MATERNITY PILLOW

BACKGROUND OF THE INVENTION

This invention relates generally to a pillow for use by expectant mothers and, more particularly, to an adjustable bifurcated pillow that supports an expectant mother's abdomen and legs.

Women in advancing stages of pregnancy typically suffer from discomfort due to a number of sources often resulting in a reduced ability to sleep. Current medical advice is for pregnant women to sleep on their side after the $18^{th}$ week of pregnancy, as opposed to sleeping on their back, particularly sleeping on the left side. More particularly, curling up or stretching out on your side, preferably with one leg crossed over the other with a pillow positioned between the legs, is recommended. Sleeping on your back can result in the increasingly growing uterus pressing on major arterial vessels possibly resulting in a decreased blood supply for both the mother and the baby. Furthermore, proper positioning and support for the abdomen enhances kidney function and a resultant improved elimination of waste and, therefore, less fluids and less swelling of the ankles, feet and hands.

It has been found that the positioning of a pillow against the back and abdomen provides relief to some of the discomfort experienced during pregnancy. Wedge pillows are known in the art, as is represented in U.S. Pat. No. 2,314,080, issued to Norman Dine, et al on Mar. 16, 1943, and in U.S. Pat. No. 6,047,419, issued to Patricia Ferguson on Apr. 11, 2000. These wedge pillows provide an elevated support for the abdomen, but, like loose pillows, are subject to movement relative to the person sleeping on them. As a result, moving from one side to the other will require a re-positioning of the pillow or pillows, thus causing a further disruption in the sleep cycle. Furthermore, wedge pillows do not provide for any support of the lower part of the body, including the legs and ankles.

A variation of the wedge pillows can be found in U.S. Pat. No. 4,397,052, issued to Richard Lund III on Aug. 9, 1983, in which the wedge pillow can be coupled to a detachable back rest section. Like the wedge pillows, this Lund variation would have to be re-positioned each time the expectant mother rolls from one side to the other to sleep. Also like the wedge pillows, the Lund variation does not provide any support for the legs and feet of the person using the pillow. Another variation of the wedge pillow can be seen in U.S. Pat. No. 5,664,271, issued to Joseph Bellavance on Sep. 9, 1997. In the Bellavance variation, there are two pillows provided, one wedge shaped pillow to support the abdomen and a second wedge pillow, connected by a connecting strap to the first pillow, to be positioned between the sleeping person's knees. As with the wedge pillows, this pillow arrangement would have to be repositioned each time the person rolls from side to side. Furthermore, the positioning of the second pillow between the sleeping person's knees could cause the pillow arrangement to dislodge or to be improperly positioned due to the second pillow being trapped between the knees, while the first pillow is merely resting beneath the abdomen of the sleeping person.

The problem of rolling from side to side and requiring a repositioning of the pillow is addressed in U.S. Pat. No. 4,506,396, issued to William Ritchie, Jr. on Mar. 26, 1985, in which a pair of pillows, interconnected by an adjustable connecting strap that has one half attached to each respective opposing pillow, can be positioned on opposing sides of the sleeping person. Each of the opposing pillows in the Ritchie patent is similar to the wedge pillows known in the art and are intended to provide support for the abdomen. The two opposing halves of the connecting strap are attachable to each other by hook and loop fastener members to provide an adjustment as to the distance between the two opposing pillows.

Similar pillow structure can be found in U.S. Pat. No. 5,182,828, issued to Margaret Alivizatos on Feb. 2, 1993; in U.S. Pat. No. 2,952,856, issued to Clarence Ruff on Sep. 20, 1960; and in U.S. Pat. No. 2,562,725, issued to Armeta Leto on Jul. 31, 1951. Each of these opposing dual pillow arrangements are provided to support the abdomen when sleeping on the person's side such that a repositioning of a pillow would not be necessary when rolling from side to side. The Ruff arrangement also provides for some adjustability by allowing the pillows to be rotated with respect to the connecting strap between the two pillows, although neither of the two pillows are movable longitudinally with respect to the connecting strap.

Similar pillow structures are provided in infant support pillows, which are intended to prevent a young infant from rolling over while reclined on a horizontal surface. As an example of an infant support pillow, U.S. Pat. No. 5,272,780, issued to Jason Clute on Dec. 28, 1993, which provides for transverse adjustment of the opposing pillows through the use of hook and loop fasteners between one of the pillows and the connecting member.

In U.S. Pat. No. 5,978,990, issued to Zhanna Akey on Nov. 9, 1999, also addresses the issue of repositioning the pillow whenever the sleeping person rolls from side to side by providing a pair of opposing pillows that depend longitudinally from a normal rectangular pillow. The opposing depending pillows are curved to define an open cavity therebetween to permit a pregnant woman to rest her abdomen on the curved portion of the adjacent pillow. The depending pillows extend sufficiently from the rectangular pillow to permit a portion thereof to be positioned between the pregnant woman's knees. Due to the flexible nature of the connection between the depending pillow extensions and the rectangular pillow, the pillow extensions are transversely movable, which like loose pillows would tend to move transversely with movement from the sleeping person. Even though one pillow extension is positionable on opposing sides of the sleeping person, these pillows would still have to be positionally adjusted each time the person rolls from side to side, thus disrupting the sleep cycle.

Utilization of wedge pillows and the like for support of a sleeping person's anatomy is not limited to pregnant women. Such support can also be utilized by people with back problems, as is recognized in U.S. Pat. No. 6,560,800, issued to Andrew Draves on May 13, 2003. This lumbar reinforcement pillow is positionable on opposing sides of the sleeping person to provide support to the abdomen and lower back of the sleeping person no matter which side the person is sleeping. Like many of the dual pillow arrangements discussed above, the opposing pillows are interconnected by a connecting member which permits transverse adjustability of the opposing pillows.

None of these pillow arrangements provide an adequate support of a pregnant woman's anatomy to provide for comfortable sleeping. The wedge pillow arrangements provide only support for the abdomen and require repositioning when the sleeping person moves from side to side. Accordingly, it would be desirable to provide a maternity pillow arrangement that will provide comfort and proper support for a pregnant woman while sleeping.

SUMMARY OF THE INVENTION

It is an object of this invention to overcome the disadvantages of the prior art by providing a maternity pillow utilizing a dual opposing pillow arrangement interconnected by an adjustable connecting member.

It is another object of this invention that the maternity pillow provides support for the pregnant woman's abdomen and legs while sleeping.

It is a feature of this invention that the maternity pillow has a sloped portion that can be positioned to support a pregnant woman's abdomen.

It is an advantage of this invention that a pregnant woman is encouraged by the maternity pillow to sleep on her side.

It is another feature of this invention that the maternity pillow also has a thick section to provide support for the pregnant woman's legs.

It is another advantage of this invention that the maternity pillow enhances proper spine orientation while the legs are supported on the thick portion of the maternity pillow.

It is still another feature of this invention that the maternity pillow is formed in an asymmetrical shape to provide proper support to the abdomen and legs, respectively, of a sleeping pregnant woman.

It is yet another feature of this invention that the sloped portion of the maternity pillow is formed with internal baffles to hold the sloped shape of the maternity pillow.

It is yet another feature of this invention that the sloped surface of the maternity pillow can be formed with quilting to hold the shape thereof.

It is still another object of this invention to provide a maternity pillow utilizing dual opposing pillow that are interconnected with an adjustable connecting member.

It is still another feature of this invention that the opposing pillows can be transversely adjusted to properly position the opposing pillows relative to the person using the pillow arrangement.

It is yet another advantage of this invention that the proper positioning of the opposing pillows will eliminate the need for repositioning each time the sleeping person moves from side to side.

It is still another advantage of this invention that the use of the maternity pillow enhances the flow of blood to the mother and baby during sleep.

It is a further feature of this invention that the connecting member is joined to the pillow case of one pillow and detachably connectable to the opposing pillow through hook and loop fasteners.

It is a further advantage of this invention that the attachment of the connecting member to the pillow case enhances the ability to wash the components of the maternity pillow.

It is still a further feature of this invention that the hook portion of a hook and loop fastener can be connected to the underside of one of the opposing pillows while a plurality of loop portions are affixed to the connecting member in a transversely spaced manner to provide adjustability of the attachment of the connecting member to the pillow.

It is still a further object of this invention to provide a maternity pillow which is durable in construction, inexpensive of manufacture, carefree of maintenance, facile in assemblage, and simple and effective in use.

These and other objects, features and advantages are accomplished according to the instant invention by providing a maternity pillow having a pair of opposing pillows interconnected by a connecting member to provide an adjustable transverse spacing between the opposing pillows. Each asymmetrical opposing pillow is formed with a sloped portion to provide proper support for the abdomen of a pregnant woman sleeping on her side and an adjacent thick portion to provide proper support for the legs of the pregnant woman. The sloped portion is formed with internal baffles to maintain the sloped configuration. The connecting member is attached to the pillow case for one of the pillows and has loop fastener strips affixed in a transversely spaced manner to permit a detachable connection to a hook strip affixed to the underside of the opposing pillow. The pillow case for the opposing pillow is formed with a reinforced opening therein to permit engagement between the hook and loop fastener strips on the pillow and connecting member, respectively.

BRIEF DESCRIPTION OF THE DRAWINGS

The advantages of this invention will become apparent upon consideration of the following detailed disclosure of the invention, especially when taken in conjunction with the accompanying drawings wherein:

FIG. 7 is a bottom plan view of the pillow cases used in conjunction with the opposing pillow members;

FIG. 8 is a bottom plan view of the second opposing pillow to depict the hook fastener strip for detachable connection with the connecting member.

DETAILED DESCRIPTION OF THE PREFERRED EMBODIMENT

Figure 1:
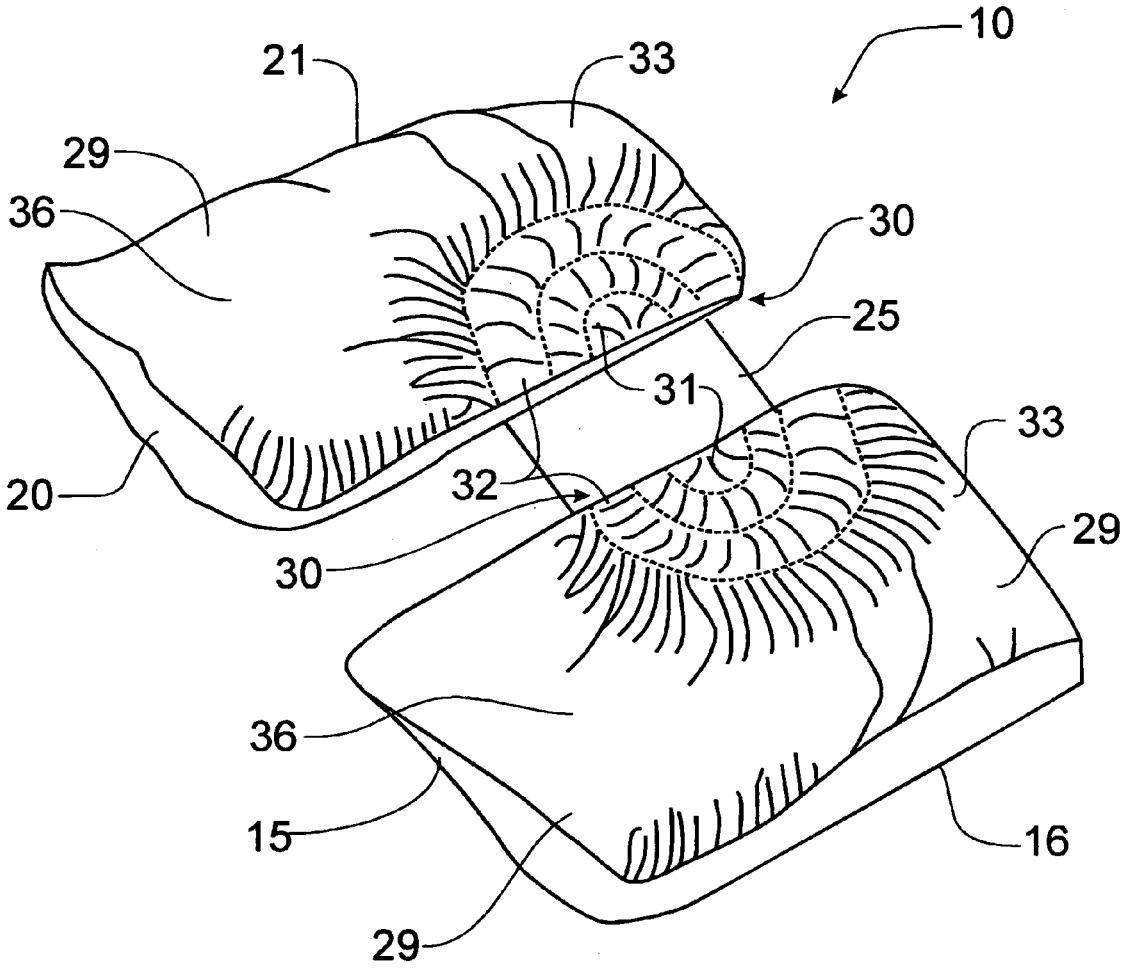
FIG. 1 is a perspective view of a maternity pillow incorporating the principles of the instant invention.
Figures 2, 4:
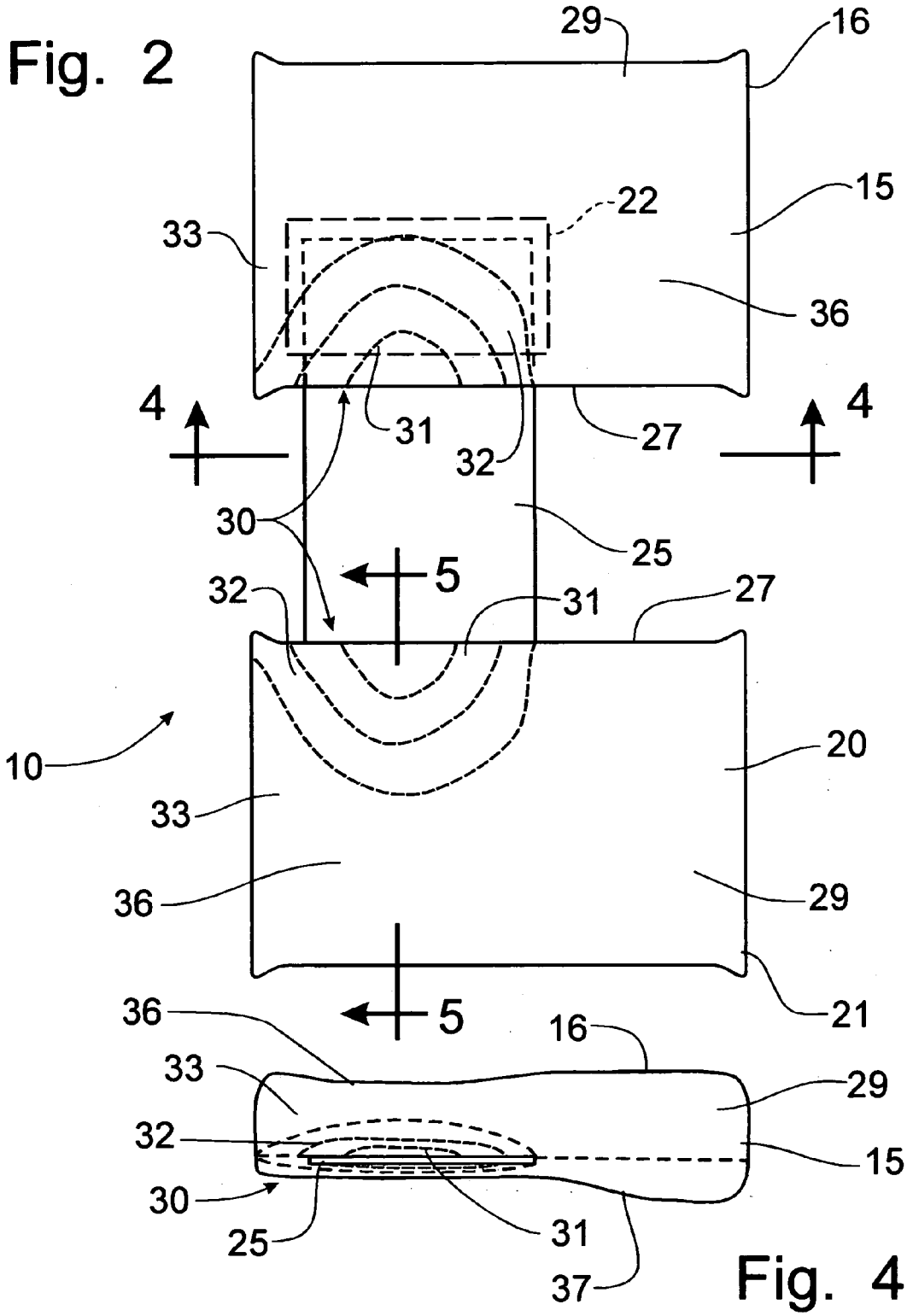
FIG. 2 is a plan view of the maternity pillow.
FIG. 4 is a cross-sectional view of the maternity pillow taken through the connecting member and corresponding to lines 4—4 of FIG. 2.
Figure 3:
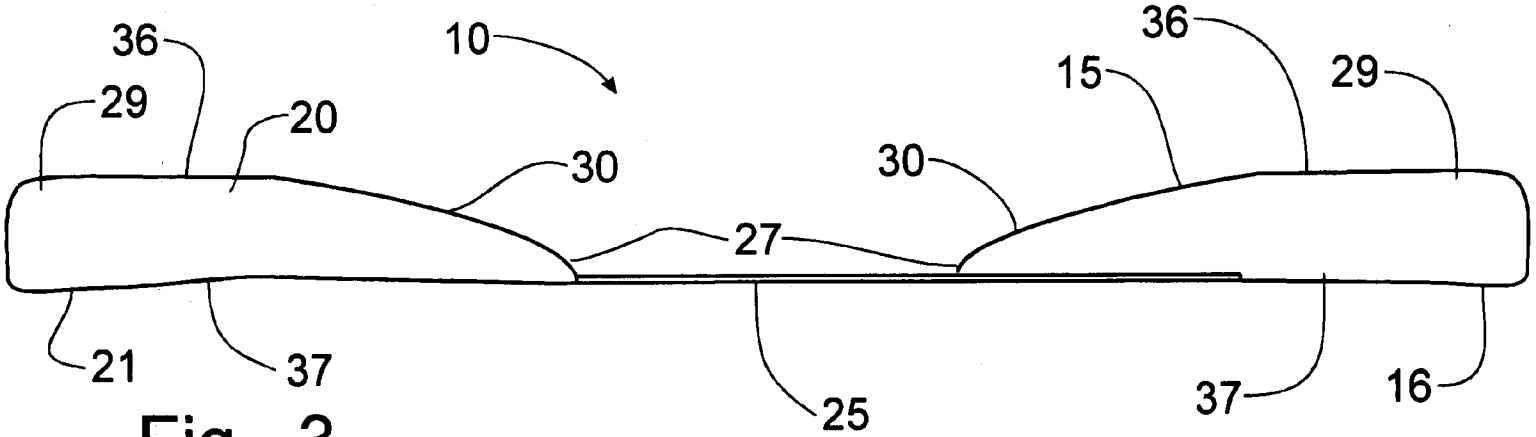
FIG. 3 is an elevational view of the maternity pillow.
Figure 5:
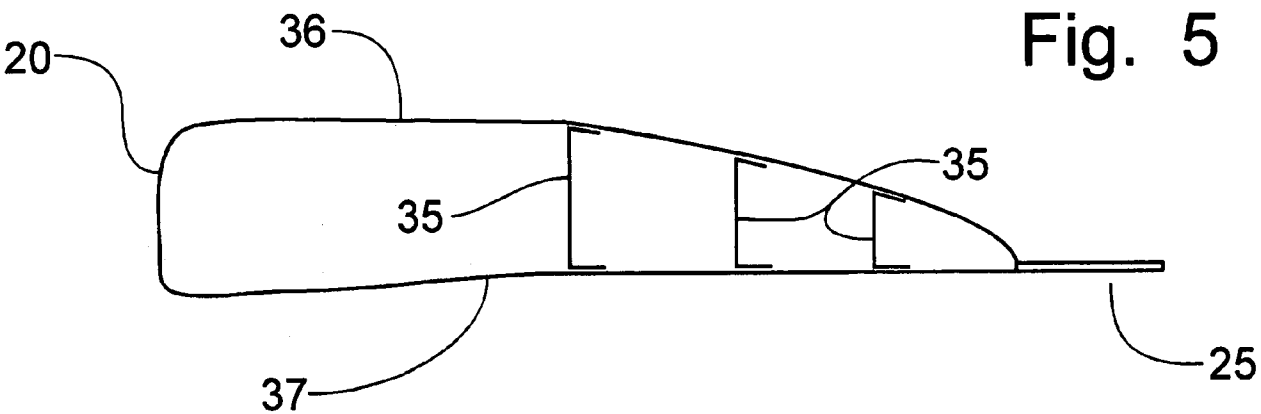
FIG. 5 is a cross-sectional view of one of the opposing pillow members taken along lines 5—5 of FIG. 2.

Referring now to FIGS. 1–3, a maternity pillow incorporating the principles of the instant invention can best be seen. The maternity pillow 10 is formed from three major components, a first pillow member 15, a second pillow member 20 and a connecting member 25 interconnecting the opposing first and second pillows 15, 20. In addition, the maternity pillow 10 includes a first pillow case 16 and a second pillow case 21 corresponding to the first and second pillow members 15, 20, which are best shown in FIG. 7. Each of the pillow members 15, 20 is formed with a sloped portion 30 and a thick portion 29 that will be described in greater detail below. The sloped portion 30 is oriented to provide support to the abdomen A of a pregnant woman W as the abdomen enlarges during the term of the pregnancy.

Figure 6:
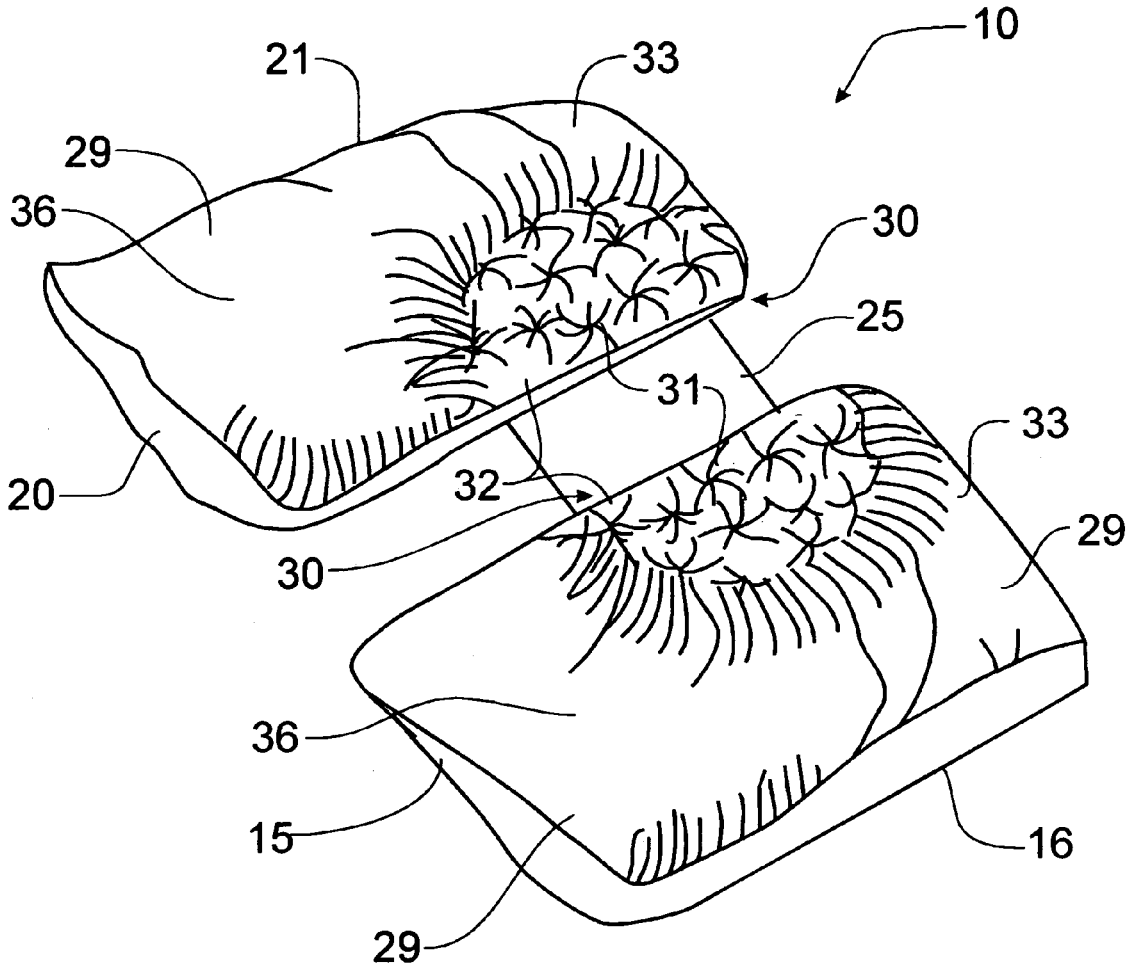
FIG. 6 is a plan view of an alternative embodiment of the maternity pillow.

Each pillow member 15, 20 is formed in an asymmetrical configuration with the sloped portion 30 being at one end of the pillow member 15, 20 and the thick portion 29 extending from behind the sloped portion 30 to the opposing end of the pillow member 15, 20. The sloped portion 30 is preferably formed into three tiers 31, 32, 33 of increasing thickness beginning with the first tier 31 at the interior edge 27 of the pillow member 15, 20. The tiers 31–33 are preferably defined by baffles 35 that are sewn to and interconnect the upper and lower surfaces 36, 37 of the respective pillow member 15, 20. The baffles 35 define chambers internally within the pillow member 15, 20 that can be stuffed to form the tiers 31–33. Alternatively, as is depicted in FIG. 6, the tiers 31–33 can be formed through a quilting process that ties the upper and lower surfaces 36, 37 of the pillow member 15, 20 at varying distances to define the tiers 31–33.

The thick portion 29 of the pillow members 15, 20 provides a support for the lower extremities L of the woman W. By sleeping on her side and resting her top leg L up onto the thick portion 29 of the pillow member 15, 20, the leg L can be maintained in proper alignment with the spine and the hip joint. For this particular reason, the pillow members 15, 20 can be alternatively utilized for people with back or lower extremity problems to keep the legs and spin of the user of the pillow 10 in proper orientation while sleeping.

The placement of the opposing pillow members 15, 20 in close proximity to one another and interconnected by the connecting member 25 to maintain the close spacing, the user is encouraged to sleep on her side and not on her back, which is recommend during the term of the pregnancy for proper blood flow to the internal organs of the woman W and the fetus. As is shown in FIGS. 1–5, the sloped portions 30 of the respective pillow members 15, 20 are positioned in opposing relationship at the interior edge 27 of the pillow members 15, 20 so that the sloped portion 30 is oriented to receive and support the abdomen A no matter on which side the woman W is sleeping.

As is depicted in FIGS. 1–5, 7 and 8, the connecting member 25 is preferably connected at one end directly to the pillow case 21 into which the corresponding pillow member 20 is placed. The pillow case 21 keeps the pillow member 20 clean and the attachment of the connecting member 25 permits the pillow case 21 and connecting member 25 to be removed from the corresponding pillow member 20 for washing of both the pillow case 21 and connecting member 25 and for the cleaning of the pillow member 20. The opposing end of the connecting member 25 has attached thereto a hook and loop fastener with the loop portion 26 thereof preferably attached to the end of the connecting member 25 and the hook portion 24 thereof attached to the pillow member 15. The connecting member 25 passes through a reinforced window 22 formed in the other pillow case 16 so that the connecting member 25 can attach through the engagement of the hook and loop portions 24, 26. Preferably, the connecting member 25 is sewn directly to the pillow case 21 for increased stability, but the connecting member 25 could also detachably connected to the pillow case 21 by additional hook and loop fasteners.

The connecting member 25 is preferably formed with a series of loop fastener strips 26 arranged in a parallel, spaced apart configuration so that a selected one of the parallel loop fastener strips 26 can be used to engage the hook fastener strip 24 affixed to the pillow member 20. In this manner, the transverse spacing of the two pillow members 15, 20 can be adjusted to accommodate different sizes of users W.

Figure 9:
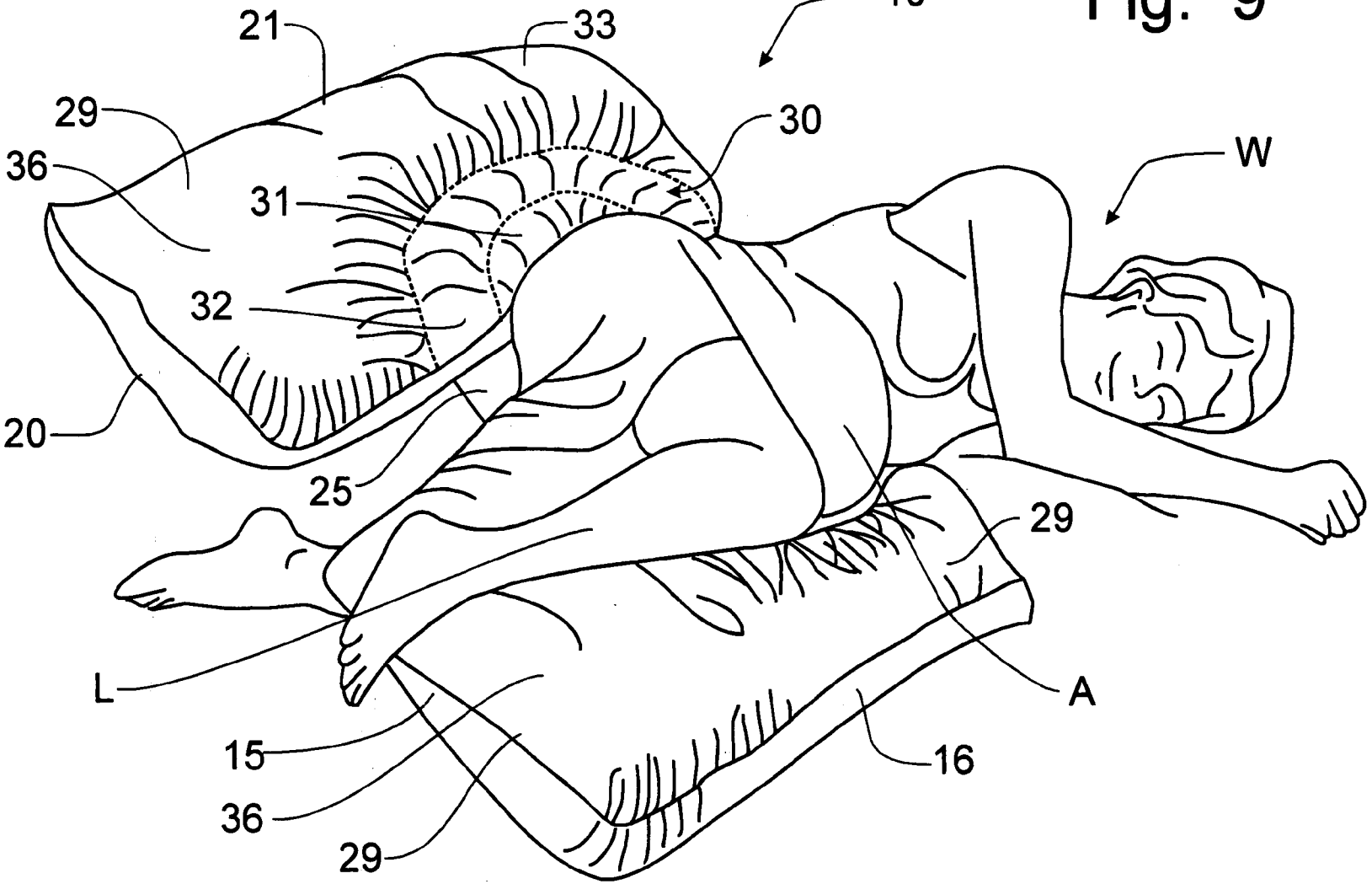
FIG. 9 is a representational perspective view of the maternity pillow incorporating the principles of the instant invention while in use.

As is depicted in FIG. 9, the maternity pillow 10 is positioned on the bed so that the first pillow 15 is on one side of the user W and the second pillow 20 on the opposite side of the user W with the connecting member 25 passing beneath the user W. The two pillows 15, 20 are sufficiently close as to impede the user W from sleeping on her back since the interior edges of the pillow would be positioned beneath the opposing sides of the user W. The sloped portion 30 of the pillows 15, 20 is oriented to be positioned immediately beneath the abdomen A of the user W for support thereof over the tiers 31–33. Preferably, the user W will position her leg L on top of the lower thick portion 29 of the pillow 15, 20 supporting the abdomen A. The height of the thick portion 29 positions the leg L at an elevation generally aligned with the user's spine to provide proper support and alignment of the lower torso of the user W. Whenever the user W rolls to her opposite side, the sloped portion 30 of the opposing pillow 20 will receive her abdomen A, allowing the user W to obtain a comfortable sleeping position without having to wrestle the pillow into appropriate position.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A maternity pillow assembly comprising:

a first pillow member formed with a sloped portion at an upper end thereof and a thick portion at an opposing lower end, said sloped portion extending from an interior edge of said first pillow toward an exterior edge with said sloped portion having a thickness dimension smaller at said interior edge than a corresponding thickness dimension of said thick portion, said sloped portion having a corresponding thickness dimension at said exterior edge substantially equal to said thickness dimension of said thick portion;

a second pillow member also being formed with a sloped portion at an upper end thereof and a thick portion at an opposing lower end, said sloped portion extending from an interior edge of said second pillow toward an exterior edge with said sloped portion having a thickness dimension smaller at said interior edge than a corresponding thickness dimension of said thick portion, said sloped portion having a corresponding thickness dimension at said exterior edge substantially equal to said thickness dimension of said thick portion; and a connecting member interconnecting the first and second pillows intermediate said upper and lower ends of the respective said pillows to maintain a predetermined spacing between the corresponding interior edges of said pillow members.

2. The maternity pillow assembly of claim 1 wherein each said pillow member includes a removable case, said connecting member being connected to a first said case.

3. The maternity pillow assembly of claim 2 wherein the second said case is formed with an opening therethrough for the passage of said connecting member to be detachably connected to said second pillow member.

4. The maternity pillow assembly of claim 3 wherein said connecting member is formed with a plurality of strips of hook and loop fastener portions arranged in a spaced apart configuration to permit engagement of a selected one of said hook and loop fastener portions with a mating hook and loop fastener portion affixed to said second pillow member to provide an adjustable transverse spacing between said pillow members.

5. The maternity pillow assembly of claim 1 wherein said sloped portions are formed in a tier configuration having relative increasing thickness dimensions with a first tier adjacent an interior edge of said pillow member having the smallest thickness dimension.

6. The maternity pillow assembly of claim 5 wherein said pillow is molded with said tier configuration being formed into an upper surface of said pillow member.

7. The maternity pillow assembly of claim 5 wherein said tier configuration is formed by baffles positioned internally of said pillow member and interconnecting an upper surface of said pillow member and an opposing lower surface of said pillow member.

8. The maternity pillow assembly of claim 7 wherein said baffles are arranged with respect to said interior edge of said pillow member in order of increasing height with the baffle closest to said interior edge having the smallest height.

9. The maternity pillow assembly of claim 1 wherein said thick portion extends from said interior edge of said lower end to said exterior edge, said sloped portion being formed in a generally circular shape and defining a tier configuration having increasing thickness with a first tier adjacent said interior edge.

10. The maternity pillow assembly of claim 1 wherein said connecting member is detachably connected to said second pillow member, said connecting member being formed with a plurality of strips of hook and loop fastener portions arranged in a spaced apart configuration to permit engagement of a selected one of said hook and loop fastener portions with a mating hook and loop fastener portion affixed to said second pillow member to provide an adjustable transverse spacing between said pillow members.

11. In a maternity pillow having a first pillow member, a second pillow member and a transverse connecting member extending therebetween, the improvement comprising:

each said pillow member being formed in an asymmetrical configuration with respect to a median line passing from an interior edge of said pillow to an exterior edge midway between an upper end of said pillow and a longitudinally opposing lower end and with a sloped portion at said upper end thereof and a thick portion at said opposing lower end, said sloped portion extending from said interior edge of said pillow toward said exterior edge with said sloped portion having a thickness dimension smaller at said interior edge than a corresponding thickness dimension of said thick portion, said sloped portion having a corresponding thickness dimension at said exterior edge substantially equal to said thickness dimension of said thick portion.

12. The maternity pillow of claim 11 wherein said sloped portion is formed in a generally circular configuration in a tiered configuration arranged in increasing thicknesses extending from said interior edge.

13. The maternity pillow of claim 12 wherein said thick portion extends from said interior edge of said lower end to said exterior edge, said sloped portion forming an indentation in said pillow surrounded by said thick portion to register with a pregnant woman's abdomen.

14. The maternity pillow of claim 12 wherein said tier configuration is formed by baffles positioned internally of said pillow member and interconnecting an upper surface of said pillow member and an opposing lower surface of said pillow member.

15. The maternity pillow of claim 14 wherein said baffles are arranged with respect to said interior edge of said pillow member in order of increasing height with the baffle closest to said interior edge having the smallest height.

16. In a maternity pillow having a first pillow member, a second pillow member and a connecting member extending therebetween, the improvement comprising:

each said pillow member being formed in an asymmetrical configuration with a sloped portion at a first end and a thick portion at an opposing second end, each said pillow member including a covering case, said first pillow member covering case being connected to said connecting member, said first pillow member being received within said first covering case, said connecting member being detachably connected to said second pillow member, said second pillow member covering case having an opening therein for passage of said connecting member for engagement with said second pillow member.

17. The maternity pillow of claim 16 wherein said sloped portion is formed in a generally circular configuration in a tiered configuration arranged in increasing thicknesses extending from said interior edge, said tier configuration being molded.

18. The maternity pillow of claim 16 wherein said connecting member is formed with a plurality of strips of hook and loop fastener portions arranged in a spaced apart configuration to permit engagement of a selected one of said hook and loop fastener portions with a mating hook and loop fastener portion affixed to said second pillow member to provide an adjustable transverse spacing between said pillow members.

19. The maternity pillow of claim 18 wherein said upper and lower ends are longitudinally spaced sufficiently to permit a pregnant woman's abdomen to be supported on said sloped portion while said thick portion at said lower end can support a knee and ankle of said pregnant woman simultaneously.

20. The maternity pillow of claim 16 wherein said sloped portion is formed in a generally circular configuration in a tiered configuration arranged in increasing thicknesses extending from said interior edge, said tier configuration being formed by baffles positioned internally of said pillow member and interconnecting an upper surface of said pillow member and an opposing lower surface of said pillow member, said baffles being arranged with respect to said interior edge of said pillow member in order of increasing height with the baffle closest to said interior edge having the smallest height.

* * * * *